United States Patent [19]

Akkerman

[11] Patent Number: 4,488,596

[45] Date of Patent: Dec. 18, 1984

[54] LOCKING APPARATUS FOR USE IN A SUBTERRANEAN WELL

[75] Inventor: Neil H. Akkerman, Kingwood, Tex.

[73] Assignee: Baker International Corporation, Orange, Calif.

[21] Appl. No.: 545,354

[22] Filed: Oct. 26, 1983

Related U.S. Application Data

[63] Continuation of Ser. No. 259,765, May 1, 1981.

[51] Int. Cl.[3] ..... E21B 23/00

[52] U.S. Cl. ..... 166/217; 285/18; 294/86.18

[58] Field of Search ..... 294/86.18, 86.26, 86.3, 294/86.31, 86.32; 166/217, 107; 285/18, 39, 141, 321; 403/321, 322

[56] References Cited

U.S. PATENT DOCUMENTS

| | | | |
|---|---|---|---|
| 3,646,996 | 3/1972 | Pearce, Jr. | 166/217 |
| 3,677,346 | 7/1972 | Tampler | 166/217 |
| 3,913,670 | 10/1975 | Ahlstone | 285/18 |
| 3,918,747 | 11/1925 | Putch | 166/217 |
| 3,972,546 | 8/1976 | Putch | 285/321 |
| 3,986,729 | 10/1976 | Taylor | 285/18 |
| 4,043,390 | 8/1977 | Glotin | 166/217 |
| 4,232,889 | 11/1980 | Putch | 285/141 |
| 4,254,829 | 3/1981 | Watkins | 166/217 |
| 4,295,528 | 10/1981 | Carmody | 166/217 |

FOREIGN PATENT DOCUMENTS

| | | | |
|---|---|---|---|
| 654712 | 12/1962 | Canada | 166/217 |

*Primary Examiner*—Stephen J. Novosad
*Assistant Examiner*—William P. Neuder
*Attorney, Agent, or Firm*—Norvell & Associates

[57] ABSTRACT

An apparatus for locking a tool into an annular groove formed on the interior of a subterranean well includes a segmented lock ring expandable into the groove by axially shiftable tapered keys wedged between segments of the ring. A latch collet between the keys and an associated running tool transmits an axial force from the running tool to the keys for wedging the keys between the segments of the segmented locking rings. After a predetermined axial travel of the running tool, the latch collet springs into the latch position, releasing the running tool and holding the keys in wedged position between the segments of the locking ring.

8 Claims, 5 Drawing Figures

LOCKING APPARATUS FOR USE IN A SUBTERRANEAN WELL

CROSS-REFERENCE TO RELATED APPLICATION

This application is a continuation application of my co-pending application Ser. No. 259,765, filed May 1, 1981, entitled "Locking Apparatus For Use In A Subterranean Well".

BACKGROUND OF THE INVENTION

1. Field of the Invention

The invention relates to a locking apparatus for securing a second apparatus carried thereon to a subterranean well conduit.

2. Description of the Prior Art

During the drilling, completion, testing, production or workover of a subterranean well, it is often desirable to removably attach tools, such as valves, to the bottom of a tubing string already in place. Thus, when it is necessary to retrieve the tool for replacement or redressing, it may be retrieved by known wire line or work string, without the need to raise the entire tubing string. The tool and an associated releasable lock are lowered through the well conduit (such as casing or tubing) and locked into a locking nipple or annular landing groove formed on the interior surface of the conduit.

Prior art locks have employed outwardly expandable locking segments adapted to engage a groove formed on the inside diameter of a section of tubing. In known locks, an annular locking plunger is axially shifted to a position radially inward of the locking segments to prevent their retraction. Typically, the annular locking plunger has an upwardly and inwardly tapering conical surface, adapted to cam the locking segments into engagement with the annular landing groove as the plunger moves upwardly. There is thus a radial compressive force on the annular plunger as it cams the locking segments into locking position and retains them. To incorporate adequate strength in such units, it is necessary that the plunger be of significant thickness. It is desirable, however, that the thickness of the plunger and the locking segments be minimized to allow other tools, such as plugs, or the like, to be run through the bore of the plunger, and to minimize restriction of the fluid flow path through the plunger.

SUMMARY OF THE INVENTION

Preferably a segmented locking ring comprises a plurality of annular segments separated by axial slots, and retained in a radially retracted position by an annular, biasing means, such as a spring, Oring, garter spring, or the like. A locking plunger or collet is operable to axially shift a plurality of keys to positions between the segments of the segmented locking ring. When the tool is to be set within the well conduit, the keys are driven upwardly by the collet into the spaces between the segments. Wedge surfaces at the ends of the keys force the ends of these segments circumferentially apart, thereby effecting the expansion of the segmented locking ring into the landing recess of the locking nipple.

When the collet head moves upwardly sufficiently to expand the segmented ring, resilient latch fingers depending from the lower portion of the locking collet snap into another annular groove on the inside surface of the locking nipple, thereby axially locking the collet into position.

When it is necessary to release the lock, the collet may be pushed downwardly by a probe, thereby removing the latch fingers from the groove and the wedged keys from the segmented ring, permitting the ring to be retracted by the biasing means from engagement with the locking nipple. The thin wall lock and any tool it carries may then be retrieved by a conventional fishing operation.

DESCRIPTION OF THE PREFERRED EMBODIMENTS

Figure 1:
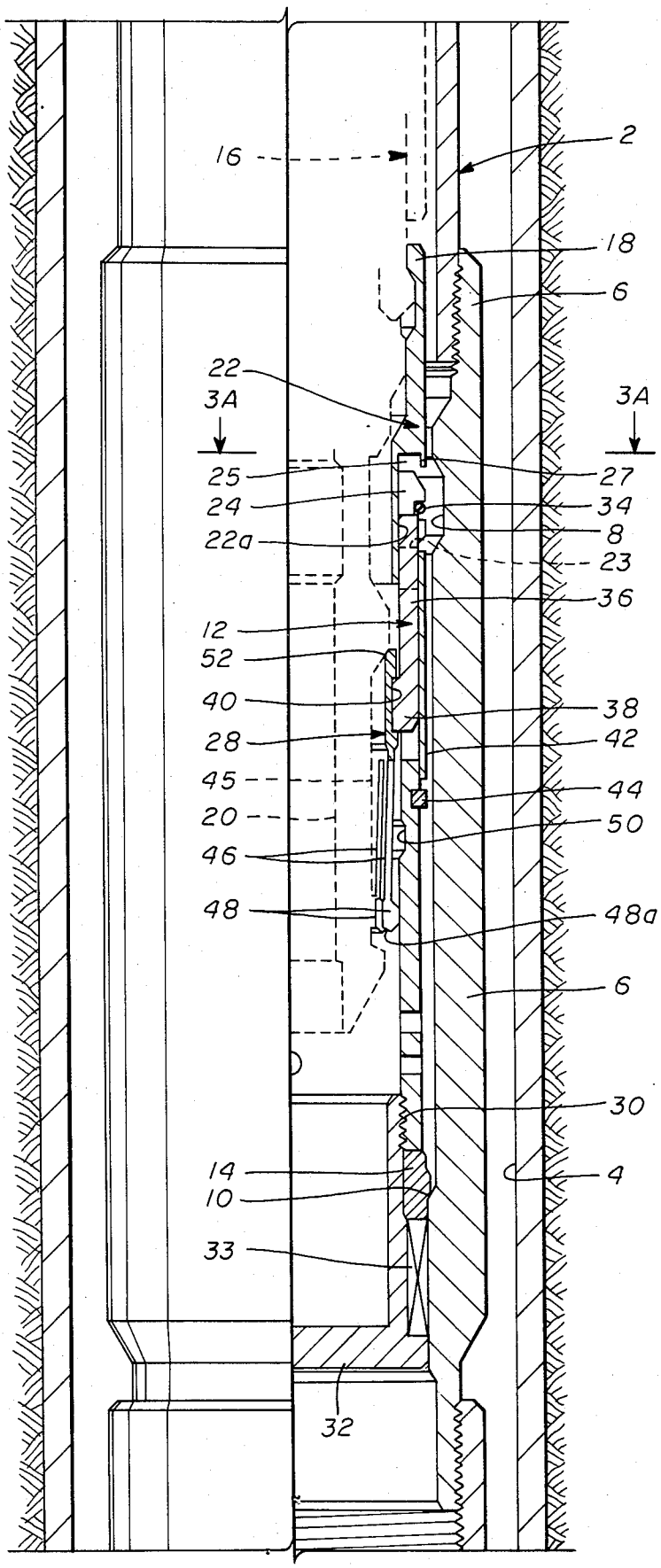
FIG. 1 is an elevational view in half-section, illustrating the thin wall lock and an associated plug landed but not yet locked in position in a downhole locking nipple.

Referring to FIG. 1, a tubing string 2 is disposed below the well surface, within the well casing 4 and includes a locking nipple 6 having an internal locking groove 8 adjacent its upper portion, and a downwardly and inwardly tapering landing shoulder 10 located near the lower portion. The thin wall lock assembly 12 embodying the present invention is shown landed in place on the shoulder 10, supported by a no-go ring 14. As illustrated, the locking assembly 12 has been run into the well on a running tool 16, illustrated in phantom line, which is the subject of co-pending application Ser. No. 259,785, filed May 1, 1981, now abandoned, and entitled "Running And Pulling Tool", other running tool 16 may be used. The running tool 16 is in engagement with a fishing neck 18 at the top of the locking assembly 12. The running tool 16 includes a lower probe 20 for setting and releasing the lock 12.

Figure 4:
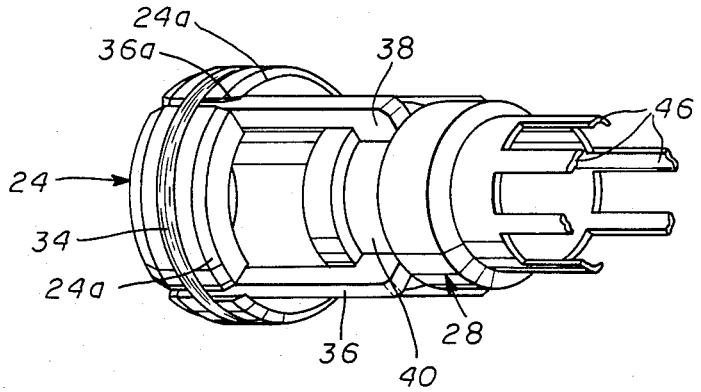
FIG. 4 is a perspective view of the wedged keys carried by the latch collet, in engagement with the segmented ring.

The thin wall lock assembly 12 comprises a lock mandrel 22, a segmented lock ring 24, keys 36, and a latch collet 28. The lock mandrel 22 is an annular housing having a fishing neck groove 18 at its upper end and internal threads 30 at its lower end, for attachment of the tool to be locked in place, such as the blanking plug 32 having an elastomeric sealing element 33. The lock mandrel 22 includes a reduced outside diameter portion defining a recess **22*a* within which is disposed the segmented locking ring 24 composed of four segments 24*a* (FIG. 4). An upwardly facing shoulder 23 defines the lower extent of the recess 22*a***.

A plurality of upwardly extending, circumferentially spaced roll pins 25 respectively extend from the segments **24*a*. An annular lip 27 depending from the upper surface of the recessed portion 22*a* of the mandrel 22 surrounds the pins 25 and prevents the segments 24*a* from radially sliding out of the recess 22*a*. An elastomeric O-ring 34 surrounds the segments 24*a***, also retaining them, by compression.

Below the locking ring 24, the lock mandrel 22 is axially slotted to receive four axially extending keys 36 (FIGS. 1 and 4). The keys 36 are circumferentially spaced and axially aligned below the gaps between the segments 24a. The upper end 36a of each key 36 is of tapered configuration. Each key 36 includes at its lower end an internally projecting lug 38, which engages an annular groove 40 formed in the latch collet 28. The keys 36 are prevented from slipping radially out of position by a key retainer sleeve 42 fitted over the keys 36 and the lock mandrel 22. The retainer sleeve 42 is kept in position by a C-ring 44 which is snapped into a cooperating annular groove 45 on the outside of the mandrel 22 during assembly of the lock assembly 12.

The latch collet 28 is slidably disposed within the mandrel 22, in engagement with the keys 36, as described. Integrally formed as the lower part of the latch collet 28 are a plurality of downwardly extending, thin sectioned latch fingers 46. The lower ends of the fingers 46 terminate in heads 48. The fingers 46 are so formed that the outside diameter around the heads 48 would normally be greater than the inside diameter of the lock mandrel 22. However, owing to the resilience of the long, thin sectioned fingers 46, the fingers 46 and the heads 48 are deflected inwardly during assembly of the tool. The heads 48, therefore, form a discontinuous annulus which is outwardly biased against the inside surface of the lock mandrel 22. The heads include downwardly facing shoulders 48a which project inwardly to engage the probe 20.

Figure 2:
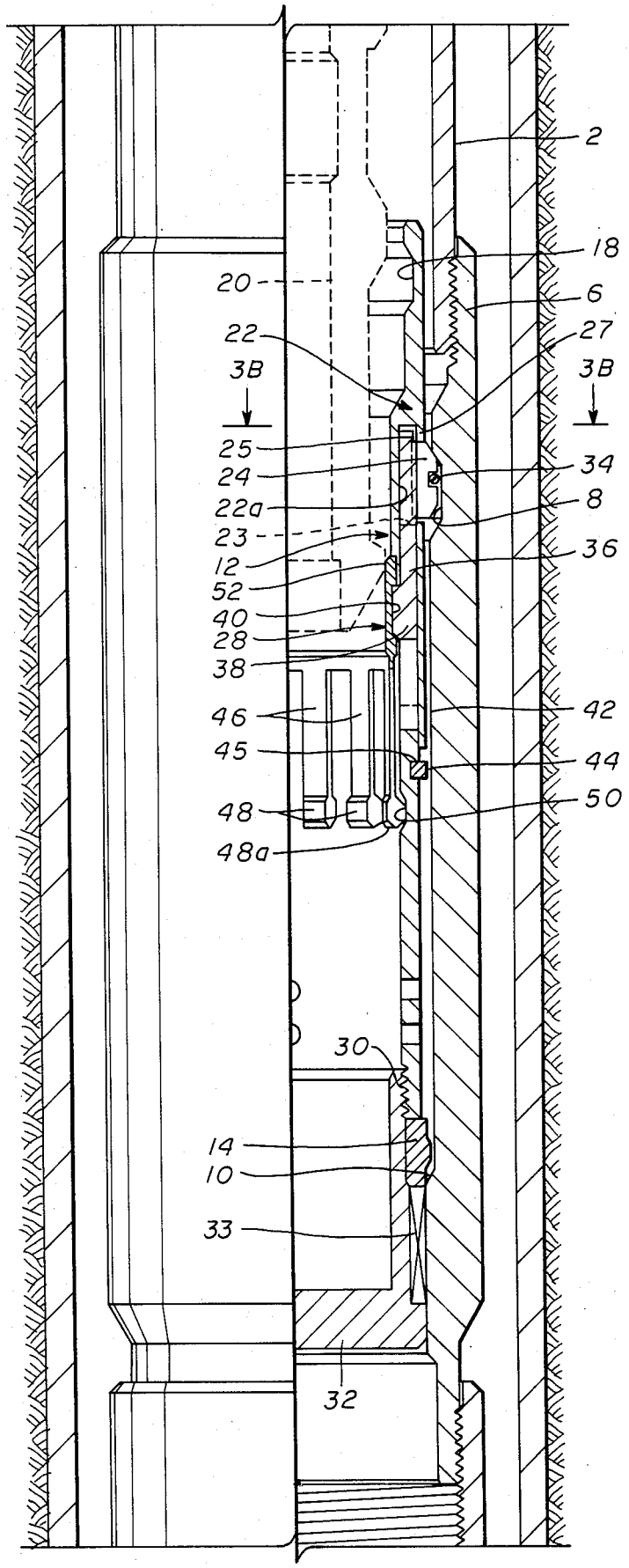
FIG. 2 is a view similar to FIG. 1, illustrating the position of the tool after the latch collet has been shifted upwardly, thereby effecting the locking of the tool.
Figure 3A:
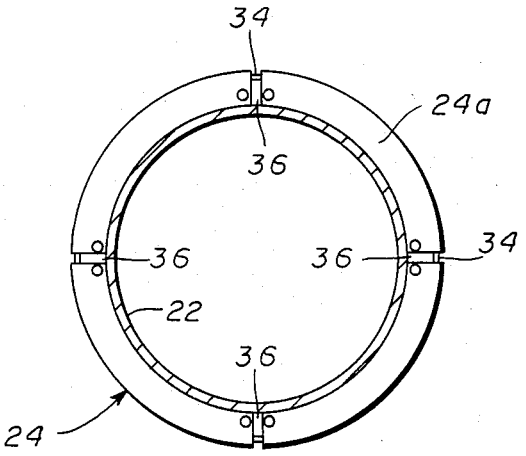
FIG. 3A is a sectional view of the segmented locking ring and plunger taken on line 3A—3A of FIG. 1.
Figure 3B:
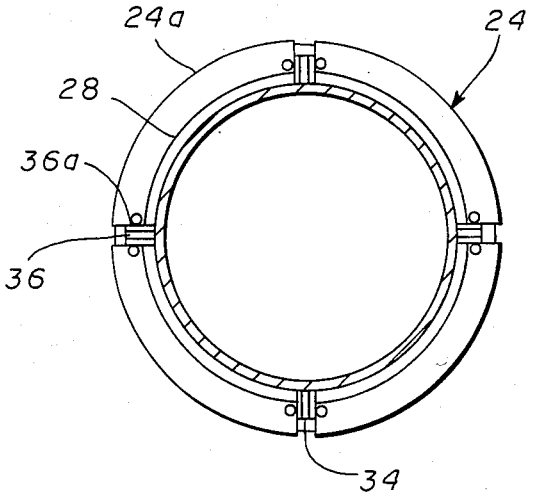
FIG. 3B is a sectional view similar to FIG. 3A taken on the line 3B—3B of FIG. 2.

As illustrated in FIG. 1, the locking assembly 12 has been carried to the desired location within the tubing string 2 by the running tool 16 in engagement with the fishing neck 18, and landed on the shoulder 10. To lock the lock assembly 12 into place, the running tool 16 is disengaged from the fishing neck 18, then raised, thus bringing the lower probe 20 into contact with the downwardly facing shoulders 48a of the latch fingers 46. Continued lifting of the lower probe 20 lifts the latch collet 28 and thus the keys 36 which are engaged in the groove 40 of the latch collar 28. The tapered upper ends 36a of keys 36 are thus driven between the segments 24a of the locking ring 24. As the tapered keys 36 are wedged between the segments 24a, the segmented locking ring 24 is circumferentially expanded, as illustrated in FIG. 3B. The ring 24 thus moves outwardly into engagement with the locking groove 8, as illustrated in FIG. 2. This wedging action continues until upward motion of the latch collet 28 brings the heads 48 into alignment with the annular groove 50 formed in the lock mandrel 22. The heads 48 of the latch fingers 46 then snap outwardly into engagement with the groove 50, thus releasing the probe 20 for removal from the well.

If there is no locking groove 8 in the appropriate position or if for any other reason the latch collet 28 is unable to move upwardly relatively to the lock mandrel 22, the probe 20 will not be released, but will lift the entire lock assembly 12 from the well.

After the fingers 46 are latched into the groove 50, both the latch collet 28 and the keys 36 carried in the groove 40 of the latch collet 28 are fixed in position relative to the lock mandrel 22. It is thus assured that the keys 36 maintain the locked ring 24 in its expanded condition.

When the lock assembly 12 is locked into position in the groove 8, upward axial forces on the blanking plug 32, or any other tool carried by the lock assembly 12, are transmitted through the threaded joint 30, to the lock mandrel 22, to the shoulder 23 at the bottom of the recess 22 to the locking ring 24, and to the locking groove 8 formed in the tube 6. The thin walled latch collet 28 is not subjected to any significant forces, but in cooperation with the keys 36 serves only to retain the ring 24 in its expanded position.

To remove the lock assembly 12 after it has been latched in place, a probe is reinserted within the lock mandrel 22 to contact a shoulder 52 defining the upper rim of the latch collet 28. Downward force on the probe springs the heads 48 of the latch fingers 46 from engagement with the annular groove 50, thus permitting the latch collet 28 and the keys 36 to be moved downwardly. The lock ring 24 will then retract from the locking groove 8, under the bias of elastomeric ring 34, permitting the lock assembly 12 and the associated tool 32 to be removed by conventional wire line technique.

The lock assembly 12 described provides a universal wire line assembly which may be utilized to carry any tool and run, land, and lock the tool in an appropriate locking groove formed in the tubing string or other well conduit. In contrast to conventional conical plungers, the keys 36 do not extend inwardly from the locking ring 24 to restrict the fluid flow path through the locking tool 12. Because the latch collet 28 does not carry extreme loads, it may be formed with a thin section, also providing a larger unrestricted flow path.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for locking a tool into a locking groove formed on the interior surface of a subterranean well conduit, comprising: a mandrel; expandable segmented locking means selectively movable to circumferentially expanded and secured position in said groove; means manipulatable by said mandrel for wedging between adjacent ends of said locking means and surface means on said manipulatable means in constant physical contact with the ends of said locking means for shifting said expandable means into circumferentially expanded position; and means engagable with an associated running tool for shifting said manipulatable means.

2. An apparatus for locking a tool into a locking groove formed on the interior surface of a subterranean well conduit, comprising: a mandrel; circumferentially expandable segmented locking means selectively movable to circumferentially expanded and secured position in said groove; means manipulatable by said mandrel for wedging between adjacent ends of said locking means and surface means on said manipulatable means in constant physical contact with the ends of said locking means for shifting said expandable means into circumferentially expanded position; and means engagable with an associated running tool for axially shifting said manipulatable means.

3. An apparatus for locking a tool carrying mandrel in an annular groove formed on the interior surface of a subterranean well conduit, comprising: a segmented ring mounted on said mandrel including a plurality of circumferentially spaced segments; and means having tapered surfaces in constant physical contact with and axially shiftable between the ends of said segments for wedging said segments apart, whereby the circumference of said segmented ring may be increased to engage the locking groove.

4. An apparatus for locking a tool into a locking groove formed on the interior surface of a subterranean well conduit, comprising: a mandrel carrying a segmented ring including a plurality of ring segments surrounding said mandrel; tapered key means carried by said mandrel in constant physical contact with the ends of said segments and axially shiftable between said segments for wedging said segments apart whereby the circumference of said segmented ring may be increased to engage the locking groove; and means engagable with an associated running tool for axially shifting said keys.

5. An apparatus for locking a tool into a locking groove formed on the interior surface of a conduit in a subterranean well, comprising: a mandrel having an annular recess formed in the outer surface thereof; a segmented ring including a plurality of ring segments within said recess, surrounding said mandrel; means for retaining said segments within said recess; tapered key means carried by said mandrel in constant physical contact with the ends of said segments and axially shiftable between said segments for wedging said segments apart whereby the circumference of said segmented ring may be increased to engage the locking groove; a collet axially shiftable within said mandrel; means for axially fixing said collet relative to said keys, whereby axial movement of said collet will control the expansion of said segmented ring; means on said collet for engaging a probe of an associated running tool, for axially shifting said keys; and releasable means for fixing the relative axial position of said mandrel and said collet.

6. An apparatus for locking a tool relative to a subterranean well conduit having a circumferential locking groove formed on the interior surface thereof, comprising: expandable segmented locking means selectively movable from a retracted position to a circumferentially expended position for engagement with said locking groove; and axially shiftable means movable form a first position to a second position in constant physical contact with the ends of said locking means, said axially shiftable means being between adjacent ends of said locking means in said second position, for wedging the locking means into the circumferential expanded position, said axially shiftable means in said second position maintaining said segmental locking means in the circumferentially expanded position in engagement with said locking groove.

7. An apparatus for locking a tool into a locking groove formed on the interior surface of a subterranean well conduit, comprising: a mandrel carrying a segmented ring including a plurality of ring segments surrounding said mandrel; tapered key means carried by said mandrel and axially shiftable between said segments, for wedging said segments apart whereby the circumference of said segmented ring may be increased to engage the locking groove; and means engagable with an associated running tool for axially shifting said keys, comprising; a collet having a ring portion abutting said keys and plurality of relatively thin, axially extending resilient latch fingers biased against the inner surface of said mandrel, said fingers having enlarged end portions to engage an associated running tool for axially shifting said collet, and wherein said mandrel includes an annular groove formed on its inside surface, whereby said enlarged portions of said fingers will expand into said groove after a predetermined axial travel, thereby releasing said running tool and locking said collet in said mandrel.

8. An apparatus for locking a tool into a locking groove formed on the interior surface of a conduit in a subterranean well, comprising: a mandrel having an annular recess formed in the outer surface thereof; a segmented ring including a plurality of ring segments within said recess, surrounding said mandrel; means for retaining said segments within said recess; tapered key means carried by said mandrel and axially shiftable between said segments, for wedging said segments apart whereby the circumferenece of said segmented ring may be increased to engage the locking groove; a collet axially shiftable within said mandrel; means for axially fixing said collet relative to said keys, whereby axial movement of said collet will control the expansion of said segmented ring; means on said collet for engaging a probe of an associated running tool, for axially shifting said keys; an annular groove formed on the interior surface of said mandrel; and releasable means for fixing the relative axial position of said mandrel and said collet, comprising; a plurality of resilient latch fingers carried by said collet and biased against the inner surface of said mandrel, and engagable with said groove in said mandrel.

* * * * *